US005099251A

United States Patent [19]

Fisher

[11] Patent Number: 5,099,251

[45] Date of Patent: Mar. 24, 1992

[54] EVERTIGHT ANTENNA MOUNTING ASSEMBLY

[75] Inventor: Roger K. Fisher, Mundelein, Ill.

[73] Assignee: The Antenna Company, Broadview, Ill.

[21] Appl. No.: 572,665

[22] Filed: Aug. 24, 1990

[51] Int. Cl.[5] ..... H01Q 1/32

[52] U.S. Cl. ..... 343/715; 343/882

[58] Field of Search ..... 343/702, 713, 715, 880, 343/882, 878, 888, 900, 905, 906; 248/53

[56] References Cited

U.S. PATENT DOCUMENTS

| | | | |
|---|---|---|---|
| 2,146,654 | 2/1939 | Shea et al. | 343/906 |
| 2,497,687 | 2/1950 | Pickett et al. | 343/882 |
| 4,109,251 | 8/1978 | MacDougall | 343/715 |
| 4,825,217 | 4/1989 | Choi | 343/715 |
| 4,882,592 | 11/1989 | Studer et al. | 343/900 |

FOREIGN PATENT DOCUMENTS

| | | | |
|---|---|---|---|
| 1217872 | 5/1960 | France | 343/882 |

*Primary Examiner*—Michael C. Wimer

*Attorney, Agent, or Firm*—Lockwood Alex Fitzgibbon & Cummings

[57] ABSTRACT

A mobile telephone antenna mounting assembly has a base member which is adhered to an exterior surface of an automobile includes two opposing sidewalls. A channel is defined between the opposing sidewalls which receives an antenna body therein. An opening extends along an axis through the opposing sidewalls and the antenna body. A mounting screw extends through the opening and engages at one end thereof, a nut recessed in one sidewall which nut is prevented from rotation when threadedly engaged by the mounting screw while the screw engages at the opposite end, a washer having a generally frusto-conical configuration which washer engages both the mounting screw head and an inner engagement surface of one of the sidewalls.

15 Claims, 1 Drawing Sheet

EVERTIGHT ANTENNA MOUNTING ASSEMBLY

BACKGROUND AND SUMMARY OF THE PRESENT INVENTION

The present invention is directed generally to mobile antenna mounting assemblies, and more specifically to a mobile telephone antenna mounting assembly which assembly holds the antenna radiating element in place while the vehicle is moving, yet permits the antenna radiating element to be repeatedly moved between its upraised position and its down position without the antenna radiating element becoming loosened.

With the advent of cellular mobile telephones, the need has arisen for antennas for such telephones which mount on the exterior window surface of a vehicle. Typically, window-mounted antennas include an outside antenna module adhered to the outside of a window glass on which a generally vertical antenna element is mounted and an inside module on the inside of the glass in registration with the outside module which contains the circuitry necessary for proper operation of the antenna.

It is customary for the separate antenna element to be attached to the outside mounting module by means of a mounting screw. This mounting screw is loosened to permit the antenna element to be either removed or pivoted between an upraised position where the antenna element is substantially vertical and a down position where the axis of the antenna element is proximate to and generally parallel to the window glass surface. It is common for the telephone user to move an antenna element from its upraised position to the down position to protect the antenna element from damage. This movement is typically required before entering a car wash because the rotating cleaning elements of the car wash may contact and severely damage the antenna element if it is in its upraised position. The mobile telephone user must then exit from his car and undo or move the antenna element down from the upraised position prior to entering the car wash and then exit from his car once more after exiting the car wash to move the antenna element to its upraised position. The latter task requires that the user keep a screwdriver readily accessible in his vehicle. The repeated tightening and loosening of the antenna mounting screw may lead to an overall loosening of the antenna mounting screw, thereby increasing the likelihood that the antenna element will fall down while the user is driving the vehicle and possibly render the antenna inoperable.

The present invention is directed to a mobile telecommunications antenna mounting assembly which overcomes the aforementioned disadvantages in that it secures the antenna from disengaging because of vehicle vibrations but also allows for quick and easy pivotal movement of the antenna between the upraised position and a down position without the need for loosening the mounting screw of the antenna element.

The antenna mounting assembly of the present invention comprises a base element having two generally parallel projecting sidewalls which define a channel therebetween which receives an antenna element therein. Each sidewall has a generally circular inner portion which permits the unrestricted rotation of an antenna mounting screw therein and a non-circular outer portion which substantially prevents or restrains the movement of the antenna screw therein by engaging the antenna screw. The outer portion of one bore has a generally frusto-conical inner engagement surface which is adapted to frictionally engage both a washer and the head of the mounting screw. All three of such surfaces are complementary. The outer portion of the other bore contains a plurality of surfaces, which surfaces abuttingly engage the outer surfaces of a threaded nut and substantially prevent the rotation of the nut within the bore outer portion.

Accordingly, it is a general object of the present invention to provide a mounting assembly for a mobile communications antenna in which an antenna radiating element is held in place by a mounting screw which assembly permits the antenna radiating element to be pivoted between an upraised position and a down position without the need for loosening the antenna element mounting screw.

Another object of the present invention is to provide a cellular antenna having an elongated antenna element held between two generally opposing sidewalls of a mounting assembly base member by way of a mounting screw-nut assembly, wherein the generally opposing sidewalls include a pair of sidewall bores, the sidewall bores having two distinct respective engagement surfaces which frictionally engage the ends of the mounting screw-nut assembly.

A further object of the present invention is to provide an antenna mounting assembly having an antenna element mounted thereon by a mounting screw which extends between a pair of projecting walls, the mounting assembly permitting virtually unlimited pivotal movement of the antenna element between an upraised position and a down position such that repeated movement between the two positions does not loosen the antenna mounting screw, the pair of projecting walls including a pair of axially aligned bores having inner and outer bore portions, the inner bore portions allowing free rotation therein of the mounting screw, the outer bore portions engaging the mounting screw and prevent it from movement within said bore.

A yet further object of the present invention is to provide a kit of parts for use in assembling an exterior mobile telephone antenna in which an antenna element is pivotally held between two opposing sidewalls of a base member by means of an antenna mounting screw wherein the screw is substantially restrained from rotational movement when the antenna element is pivoted.

These and other objects, features and advantages of the present invention will be apparent from the following detailed description, taken in conjunction with the accompanying drawings wherein in like reference numerals refer to like parts.

BRIEF DESCRIPTION OF THE DRAWINGS

In the course of this description reference will be made to the attached drawings in which.

DETAILED DESCRIPTION OF THE PREFERRED EMBODIMENT

Figure 1:
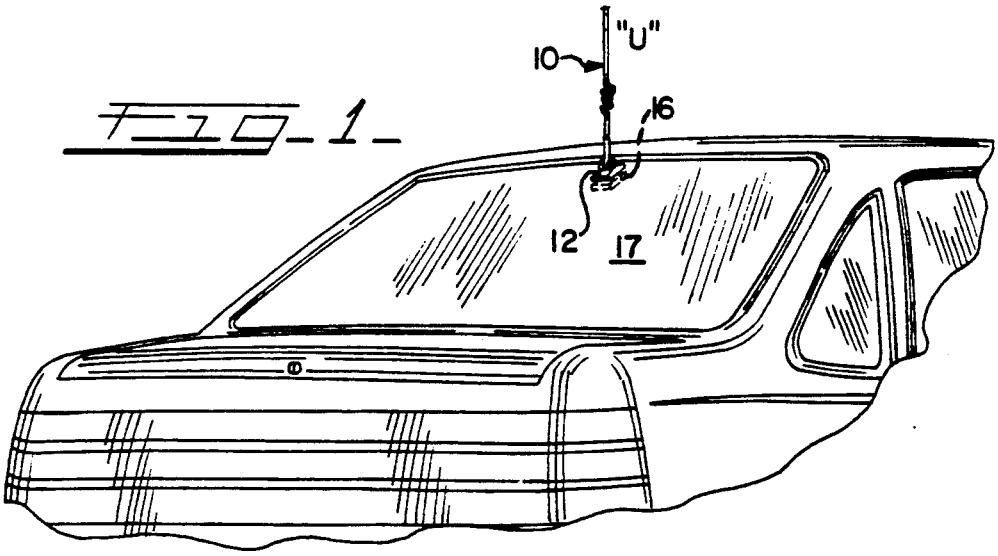
FIG. 1 is a perspective view of an antenna mounting assembly constructed in accordance with the principles of the present invention in place on the exterior glass window of a vehicle wherein the antenna is in an upraised position.
Figure 2:
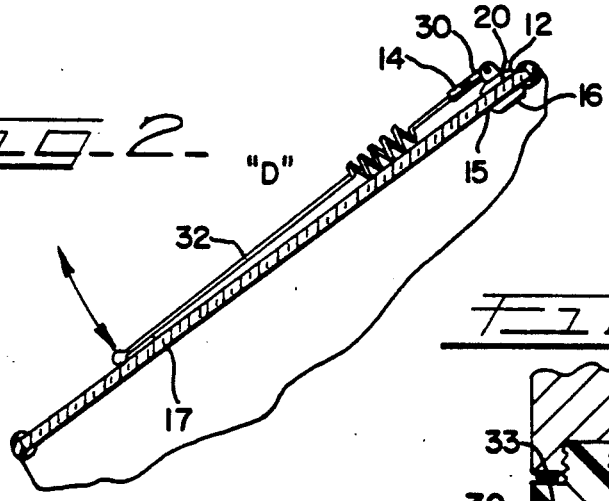
FIG. 2 is an elevational view of the antenna mounting assembly of FIG. 1 wherein the antenna is in a down position.

Referring to the drawings and in particular to the FIGS. 1-2, a mobile telephone antenna mounting assembly 10, constructed in accordance with the principles of the present invention is shown as having an exterior antenna module 12 and an antenna element 14 held thereby which generally extends vertically from the module 12. In accordance with conventional practice, the exterior antenna module 12 is mounted to the exterior surface of the window glass 17 in registration with an inner antenna module 16, shown in phantom. The exterior antenna module 12 may be attached to the window glass 17 by a conventional adhesive layer 15 formed from a length of double-sided adhesive tape or the like, a plurality of spots or dabs of epoxy or other materials.

Figure 4:
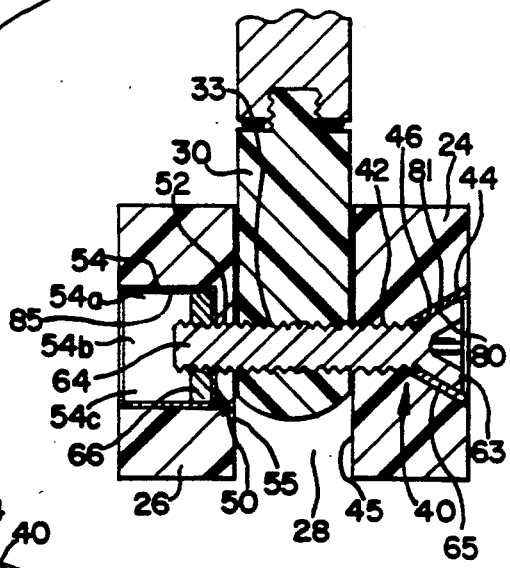
Figure 3:
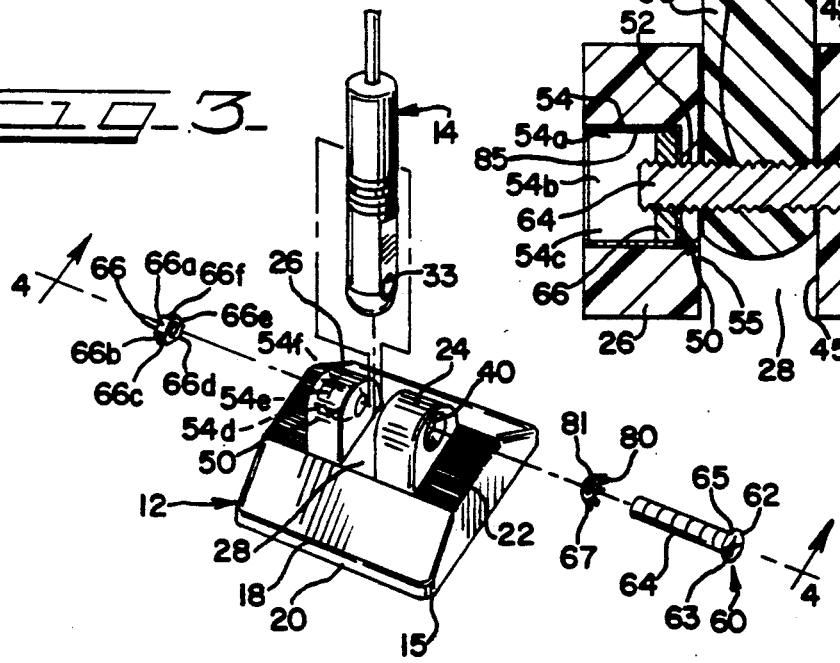
FIG. 3 is an exploded perspective view of the antenna mounting assembly of FIG. 1; and, FIG. 4 is a cross-sectional view of the antenna mounting assembly of FIG. 1 taken along line 4—4.

Referring now to FIGS. 3 and 4, the exterior antenna module 12 includes a generally rectangular base 18, which is preferably cast or otherwise formed from an electrically conductive metal such as aluminum, copper, zinc or alloys thereof. The rectangular base 18 is formed with a generally flat base surface 20 and an opposing mounting surface 22. Extending outwardly from the base 18 and opposite the mounting surface 22 are two generally opposing projecting sidewalls 24, 26 which are preferably formed integrally with the mounting assembly base 18.

The two sidewalls 24, 26 are generally parallel and are spaced apart from each other a preselected distance to define a channel 28 therebetween which receives the lower body portion 30 of an antenna radiating element in a general interference fit. As will be explained in greater detail below, the antenna mounting assembly of the present invention is designed to secure the elongated antenna whip portion 32 against rotational movement between an upraised position "U" and a down position "D", while the vehicle is being operated, yet also permits repeated pivotal movement by hand of the antenna element 14 between the upraised and down positions without loosening the antenna mounting screw 62.

The sidewalls 24, 26 each include a bore 40, 50. Bores 40, 50 are preferably axially aligned with each other and each bore has a two-part configuration, as is shown best in FIG. 4. Importantly, each bore has a respective inner bore portion 42, 52 opening out to the inner surfaces of 45, 55 of the projecting sidewalls 24, 26. Proximate to and exterior of the bore inner portions 42, 52 are two bore outer portions or counterbores 44, 54. In contrast to the configuration of the sidewall bore inner portions 42, 52 which are generally circular, the configurations of the sidewall bore outer portions 44, 54 are configured to engage surfaces of the mounting screw-nut assembly 60. In this regard, the sidewall bore inner portions 42, 52 do not substantially engage any surfaces of the antenna mounting screw 60, thereby allowing the screw shaft 64 a minimum clearance within the inner portions 42, 52 and between the inner surfaces thereof. The sidewall bore outer portions 44, 54 actively engage surfaces of the mounting screw-nut assembly 60 at the opposing ends thereof to hold the mounting screw-nut assembly 60 firmly in place within the sidewalls 24, 26.

The mounting screw-nut assembly 60 includes a screw 62 having a screw head 63 and an elongated threaded screw shaft 64. The screw head 63 preferably includes a frictional engagement surface 65 generally complimentary in configuration to the first bore outer portion 44. At its opposite end, the screw shaft 64 receives a threaded nut, shown as a hex nut 66 having a plurality of outer surfaces **66*a*-66*f***.

In another important aspect of the present invention, the mounting screw nut assembly 60 includes a frictional washer member, shown as a "panhead" washer 67 which has a generally tapered or frusto-conical configuration which includes opposing inner and outer engagement surfaces 80, 81. The washer is complementary in its configuration to both the screw head outer engagement surface 65 and an engagement surface 46 of the first bore outer portion 44. The washer 67 cooperates with the frusto-conical engagement surface 65 of the mounting screw 62 and the first bore outer portion engagement surface 46, to hold the mounting screw 62 in place when the mounting screw 62 is inserted into the sidewall bores 40, 50 a nut 66 is threaded onto the shaft thereof 64. In assembling the mounting screw-nut assembly 60 onto the mounting base member 18, the frictional washer 67 is first placed and positioned on the screw shaft 64 proximate to the screw head 63. The mounting screw 62 is then inserted into the first sidewall bore 40 in a manner so that it first passes through the first sidewall bore 40, then passes through an antenna mounting hole or bore 33 of the lower body portion 30 of the antenna radiating element which is aligned with the first bore 40 and then finally through the second sidewall bore 50. The screw shaft 64 preferably extends through the second sidewall bore inner portion 52 and into the outer portion 54 thereof, where it engages the hex nut 66.

Specifically, the sidewall second bore outer portion 54 has a configuration which is different from its adjoining second bore inner portion 52 and which is complementary in configuration to the nut 66. In this regard, the second bore outer portion 54 has a hexagonal configuration with six engagement surfaces **54*a*-54*f*. (FIG. 3) Each of these second bore outer portion engagement surfaces 54*a*-54*f* engage a corresponding surface 66*a*-66*h* of the hex nut 66. The engagement surfaces 54*a*-54*h* associated with the second bore outer portion 54 may either be integrally formed in the sidewall 26, such as by casting or may be formed by the insertion of a separate insert member 85 having a configuration complementary to that of the hex nut 66 into the sidewall 26. Although a hex nut and hexagonal second bore outer portion configuration are illustrated, it will be appreciated that other styles of nuts can be used, such as square nuts, so long as the second bore outer portion has at least one inner frictional engagement surface which engages a surface of the nut 66** and substantially prevents it from turning.

When the mounting screw 62 is threadedly engaged on the nut 66 and firmly tightened thereto, the screw head 63 and the nut 66 cooperate to induce a tensile stress or tension force on the mounting screw 62 which tends to axially pull the mounting screw 62 in opposite directions toward the outer surfaces of the base member sidewalls 24, 26, thereby compressively forcing the screw head 63 into frictional engagement with the washer 67. The screw head 63 and the washer 67 are further forced against the first bore outer portion engagement surface 46 by the tension induced by the nut 66, whereby the antenna element is firmly held in place within the sidewalls 24, 26 and the mounting screw itself is restrained from any appreciable rotational movement within the bores 40, 50 when the antenna element 30 is moved between its upraised and down positions. Since the mounting screw will not work loose, the mobile telephone user need not repeatedly tighten the screw after moving the antenna element to ensure the integrity of the mounting assembly.

It will be appreciated that the embodiments of the present invention that has been discussed herein are merely illustrative of a few applications of the principles of the invention. Numerous modifications may be made by those skilled in the art without departing from the true spirit and scope of the invention.

I claim:

1. An automobile cellular telephone antenna comprising:

a mounting member having a generally flat base portion;

two projecting walls extending away from a first surface of the mounting member, the two projecting walls defining a channel therebetween;

a lower base portion of an elongated antenna radiating element disposed in said channel in an interfitting relationship with said projecting walls, the radiating element lower base portion being held between said two projecting walls in a pivotal relationship to said mounting member;

said two projecting walls each having a bore therein, the projecting wall bores sharing a common axis, the first bore having adjoining inner and outer portions, the first bore inner portion receiving a shaft of an antenna element mounting screw therein, the first bore outer portion receives means to restrict the movement of the mounting screw when said antenna element is pivoted on said mounting member between a first and second antenna element position, the second bore also having adjoining inner and outer portions, the second bore inner portion receiving said mounting screw shaft and the second bore outer portion having a plurality of engagement surfaces which positively engage nut means threadedly engaging said mounting screw shaft, said second bore outer portion engagement surfaces generally abutting a plurality of complementary shaped engagement surfaces of said nut means, said second bore outer portion engagement surfaces substantially restricting the nut means from any rotational movement on said mounting screw shaft, said mounting screw movement restriction means exerting a frictional force on said mounting screw and a surface of said first bore outer portion, whereby said antenna element can be pivoted between said first and second positions without substantial rotational movement of said mounting screw, said mounting screw movement restriction means including a washer member having a generally frusto-conical configuration which is carried on said mounting screw, the washer member having an inner engagement face and an outer engagement face, said washer member inner engagement face engaging a portion of the head of said mounting screw and said washer member outer engagement face engaging said first bore outer portion, said first bore outer portion also having a general frusto-conical configuration.

2. The cellular antenna of claim 1, wherein said washer member includes a panhead lock washer and said second bore outer portion includes a hex nut insert, the insert having six engagement surfaces thereon.

3. The cellular antenna of claim 1, wherein said second bore outer portion includes a counterbore having a plurality of engagement surfaces corresponding in number to the number of engagement surfaces on said nut means, each counterbore engagement surface engaging an opposing engagement surface of said nut means.

4. The cellular antenna of claim 1, wherein said second bore outer portion includes a counterbore having a plurality of second bore outer portion engagement surfaces corresponding in number to the number of engagement surfaces on said nut means, each second bore outer portion engagement surface engaging an engagement surface of said nut means.

5. The cellular antenna of claim 3, wherein said nut means is a hex nut and said second bore outer portion counterbore includes a hex insert.

6. The cellular antenna of claim 1, wherein said mounting member generally flat base portion includes a layer of adhesive means.

7. The cellular antenna of claim 1, wherein said nut means induces a tension force in said mounting screw and a compression force in said washer member, thereby causing said washer member to frictionally engage said mounting screw and said sidewall first bore outer portion.

8. The cellular antenna of claim 1, wherein said washer member inner and outer engagement surfaces, said mounting screw head and said first bore outer portion are all generally complementary in configuration.

9. A mobile telephone mounting assembly for mounting a mobile telephone antenna on an exterior surface of an automobile, said assembly permitting pivotal movement of the antenna element mounted therein between a first antenna position and a second antenna position, comprising, in combination: a mounting assembly base-member having a pedestal portion, the pedestal portion having a first substantially flat mounting surface for engaging the exterior surface of the automobile, the pedestal portion having a second surface having a pair of spaced-apart opposing sidewall portions projection away from said second surface, the two opposing sidewall portions defining a channel therebetween, a base portion of an antenna element being disposed within said channel between said two sidewall portions, the antenna element base portion being held in said channel in a pivotal relationship by an elongated mounting screw having a screw head and an elongated threaded shaft, said two sidewall portions including opposing first and second openings, the opposing first and second openings being aligned along a common axis within said two sidewall portions, each one of said two sidewall portion first and second openings having an inner portion with a generally circular configuration which is adapted to receive a portion of the elongated mounting screw therein without substantially engaging said mounting screw, said two sidewall portion first and second openings further including respective outer portions disposed generally adjacent to said first and second opening inner portions, the configuration of each of said two sidewall portion first and second opening outer portions being substantially different than the configuration of said two sidewall first and second opening inner portions, said elongated mounting screw being disposed in said two sidewall first and second openings and extending axially between said two sidewall portion first and second opening outer portions, non-circular nut means disposed in said sidewall portion second opening, the nut means being adapted to threadedly engage said elongated mounting screw threaded shaft, said sidewall portion second opening outer portion having at least one inner engagement surface which engages an outer engagement surface of said nut means and prevents said nut means from rotational movement within said sidewall portion second opening outer portion when said nut means threadedly engages said mounting screw shaft, and means for restraining rotational movement of said antenna mounting screw within said sidewall portion first and second openings relative to said base two sidewall portions, the mounting screw movement restraining means including a panhead lock washer and said mounting screw includes a panhead screw, said mounting screw movement restraining means substantially preventing rotational movement of said antenna mounting screw within said sidewall portion first and second openings when said antenna element is moved between said first and second positions.

10. The mobile telephone mounting assembly of claim 9, wherein said nut means includes a hex head nut having six outer engagement surfaces and said sidewall portion second opening outer portion includes a hex head insert having six inner engagement surfaces, each of said insert inner engagement surfaces abuttingly engaging an outer engagement surface of said hex head nut.

11. The mobile telephone mounting assembly of claim 9, wherein said mounting screw movement restraining means further includes said sidewall portion first opening outer portion having a frusto-conical inner surface, the outer surface of said antenna mounting screw head and said panhead lock washer each having a frusto-conical configuration, said panhead lock washer frictionally contacting said sidewall portion first opening outer portion frusto-conical inner surface and said antenna mounting screw head outer surface, whereby substantial rotational movement of said antenna mounting screw within said sidewall first and second openings is prevented.

12. The mobile telephone mounting assembly of claim 9, wherein said base member first mounting surface includes adhesive means.

13. A kit of parts for use in assembling a mobile telephone antenna in which the antenna can be pivoted between one or more antenna positions, which when assembled form a mobile telephone antenna, comprising:

an antenna base member having a first substantially flat surface for mounting on an exterior surface of a vehicle, the antenna base member having two outwardly extending sidewalls disposed generally parallel to each other on a second surface thereof, each of the two sidewalls having a bore extending therethrough, said two sidewalls defining a channel therebetween to interfittingly receive an antenna element therein, each sidewall bore including adjacent inner and outer portions, the sidewall bore inner portions being adapted to receive a portion of an antenna element mounting screw therein without any engagement thereof, one of said sidewall bore outer portions having an inner surface for engaging a screw head of said mounting screw and the other of aid sidewall bore outer portions having at least one inner, non-circular engagement surface for engaging an engagement surface of a mounting screw nut;

an elongated antenna element having a lower base portion which is received by said channel extending sidewalls, the antenna element lower base portion including a bore extending therethrough and in alignment with said two outwardly extending sidewall bores; and, an antenna element mounting screw nut assembly, the mounting screw nut assembly including said mounting screw, said mounting screw having a threaded shaft extending from a screw head thereof, a nut which threadedly engages said mounting screw threaded shaft, said nut having at least one outer, non-circular engagement surface which abuttingly engages the inner engagement surface of said other sidewall bore outer portion, whereby rotation of said nut on said threaded shaft is substantially prevented when said nut is inserted into said other sidewall bore outer portion and threaded onto said mounting screw, and frictional washer means frictionally engaging a surface of said mounting screw head and a surface of one said sidewall bore outer portion, each of said mounting screw head and said frictional washer means having a generally frusto-conical configuration and said inner engagement surface of said one sidewall bore outer portion is generally frusto-conical whereby rotation of said mounting screw relative to said base member sidewalls is substantially prevented when said antenna element is pivoted.

14. A kit according to claim 13, wherein said mounting screw has a panhead screw head and said frictional washer means is a panhead washer.

15. A kit according to claim 13, wherein said nut is a hex nut and said other of said sidewall bore outer portion includes a hex insert which engages said hex nut.

* * * * *